US008156609B2

(12) United States Patent
Milne et al.

(10) Patent No.: US 8,156,609 B2
(45) Date of Patent: Apr. 17, 2012

(54) HANDHELD CLEANING APPLIANCE

(75) Inventors: William Frame Milne, Malmesbury (GB); William Robert James White, Malmesbury (GB)

(73) Assignee: Dyson Technology Limited, Malmesbury (GB)

( * ) Notice: Subject to any disclaimer, the term of this patent is extended or adjusted under 35 U.S.C. 154(b) by 442 days.

(21) Appl. No.: 12/307,112

(22) PCT Filed: Jul. 6, 2007

(86) PCT No.: PCT/GB2007/002543

§ 371 (c)(1),
(2), (4) Date: Jul. 31, 2009

(87) PCT Pub. No.: WO2008/009891

PCT Pub. Date: Jan. 24, 2008

(65) Prior Publication Data

US 2009/0307863 A1 Dec. 17, 2009

(30) Foreign Application Priority Data

Jul. 18, 2006 (GB) ..... 0614237.6
Sep. 20, 2006 (GB) ..... 0618494.9

(51) Int. Cl.
*A47L 9/00* (2006.01)

(52) U.S. Cl. ..... 15/344; 15/352; 15/353

(58) Field of Classification Search ..... 15/327.2, 15/327.5, 344, 347, 352, 353; *A47L 9/10*
See application file for complete search history.

(56) References Cited

U.S. PATENT DOCUMENTS

| | | | | |
|---|---|---|---|---|
| 5,692,262 | A | 12/1997 | Haupt et al. | |
| 7,640,624 | B2 * | 1/2010 | Crouch et al. | 15/352 |
| 2005/0229355 | A1 | 10/2005 | Crouch et al. | |
| 2006/0162117 | A1 | 7/2006 | Thomas et al. | |

FOREIGN PATENT DOCUMENTS

| | | |
|---|---|---|
| GB | 1 207 278 | 9/1970 |
| GB | 1 261 906 | 1/1972 |
| GB | 2 035 787 | 6/1980 |
| GB | 2 330 786 | 5/1999 |
| GB | 2 388 307 | 11/2003 |
| GB | 2 407 784 | 5/2005 |

(Continued)

OTHER PUBLICATIONS

GB Search Report, dated Nov. 8, 2006, directed to counterpart GB Patent Application No. 0614237.6; 1 page.

(Continued)

*Primary Examiner* — David Redding
(74) *Attorney, Agent, or Firm* — Morrison & Foerster LLP

(57) ABSTRACT

A handheld cleaning appliance includes a dirty air inlet, a clean air outlet and separating apparatus for separating dirt and dust from an airflow in an airflow path leading from the air inlet to the air outlet. The separating apparatus includes a cyclonic separator having at least one cyclone and a collector having a wall and a base member, the base member being held in a closed position by a catch and being pivotably connected to the wall. The appliance further includes a main body which incorporates an actuator for operating the catch. The actuator has a slidably mounted rod which is movable between an inoperative position and an actuating position in which the rod contacts part of the catch so as to allow the collector to be opened for emptying purposes. This arrangement allows the catch to be released without the user actually touching the collector.

11 Claims, 4 Drawing Sheets

FOREIGN PATENT DOCUMENTS

| | | |
|---|---|---|
| JP | 2004-49792 | 2/2004 |
| JP | 2005-261963 | 9/2005 |
| WO | WO-2006/076363 | 7/2006 |

OTHER PUBLICATIONS

GB Search Report, dated Dec. 18, 2006, directed to counterpart GB Patent Application No. 0618494.9; 1 page.

International Search Report and Written Opinion, mailed on Oct. 8, 2007, directed to counterpart International Patent Application No. PCT/GB2007/002543; 8 pages.

International Preliminary Report on Patentability, dated Nov. 17, 2008, directed to counterpart International Patent Application No. PCT/GB2007/002543; 5 pages.

* cited by examiner

HANDHELD CLEANING APPLIANCE

REFERENCE TO RELATED APPLICATIONS

This application is a national stage application under 35 USC 371 of International Application No. PCT/GB2007/002543, filed Jul. 6, 2007, which claims the priority of United Kingdom Application Nos. 0614237.6 and 0618494.9, filed Jul. 18, 2006, and Sep. 20, 2006, respectively, the contents of which prior applications are incorporated herein by reference.

FIELD OF THE INVENTION

The invention relates to a handheld cleaning appliance particularly, but not exclusively, to a handheld vacuum cleaner. More particularly, the invention relates to a handheld cleaning appliance having a cyclonic separator.

BACKGROUND OF THE INVENTION

Handheld vacuum cleaners are well known and have been manufactured and sold by various manufacturers for several years. Typically, a handheld vacuum cleaner comprises a casing which houses a motor and fan unit for drawing air into the cleaner via an inlet, and a separation device such as a filter or bag for separating dirt and dust from the incoming airflow. An example of such a vacuum cleaner is shown in GB1207278.

Handheld vacuum cleaners have more recently been developed to incorporate cyclonic separation systems which are capable of removing larger items of debris from the airflow before removing finer particles using a filter or other barrier means. An example of such a device is sold by Black & Decker under the trade name DUSTBUSTER®. Further examples of handheld vacuum cleaners incorporating cyclonic separators are shown in GB2035787A and WO2006/076363.

A disadvantage of known handheld vacuum cleaners which utilise cyclonic separators is that emptying the appliance of dirt and dust collected therein can be awkward, inconvenient and messy. In some cases, a compartment of the appliance must be physically removed from the rest of the appliance, transported to a suitable receptacle, emptied and then replaced on the appliance. Removal of a portion of the appliance inevitably carries with it a risk that the portion will not be replaced correctly and this can adversely affect the performance of the appliance. In other arrangements, the opening of the compartment in which the dirt and dust is collected involves awkward manipulation of the appliance as a whole. When the appliance has been designed for ease of handling during the cleaning operation, the emptying process can increase the risk of the appliance being inadvertently dropped and broken during emptying. It is therefore an object of the invention to provide a handheld cleaning appliance which is easier and more convenient to empty than known handheld vacuum cleaners.

SUMMARY OF THE INVENTION

The invention provides a handheld cleaning appliance comprising a dirty air inlet, a clean air outlet and separating apparatus for separating dirt and dust from an airflow in an airflow path leading from the air inlet to the air outlet, the separating apparatus comprising a cyclonic separator having at least one cyclone and a collector having a wall and a base member, the base member being held in a closed position by means of a catch and being pivotably connected to the wall, the appliance further including a main body which incorporates an actuator for operating the catch, characterized in that the actuator comprises a slidably mounted rod which is movable between an inoperative position and an actuating position in which the rod contacts part of the catch so as to allow the collector to be opened for emptying purposes.

This arrangement allows the catch to be released without the user actually touching the collector. It also provides a compact, reliable mechanism for remotely emptying the collector in a cost-efficient manner.

BRIEF DESCRIPTION OF THE DRAWINGS

An embodiment of the invention will now be described with reference to the accompanying drawings, in which.

DETAILED DESCRIPTION OF THE INVENTION

Figure 1:
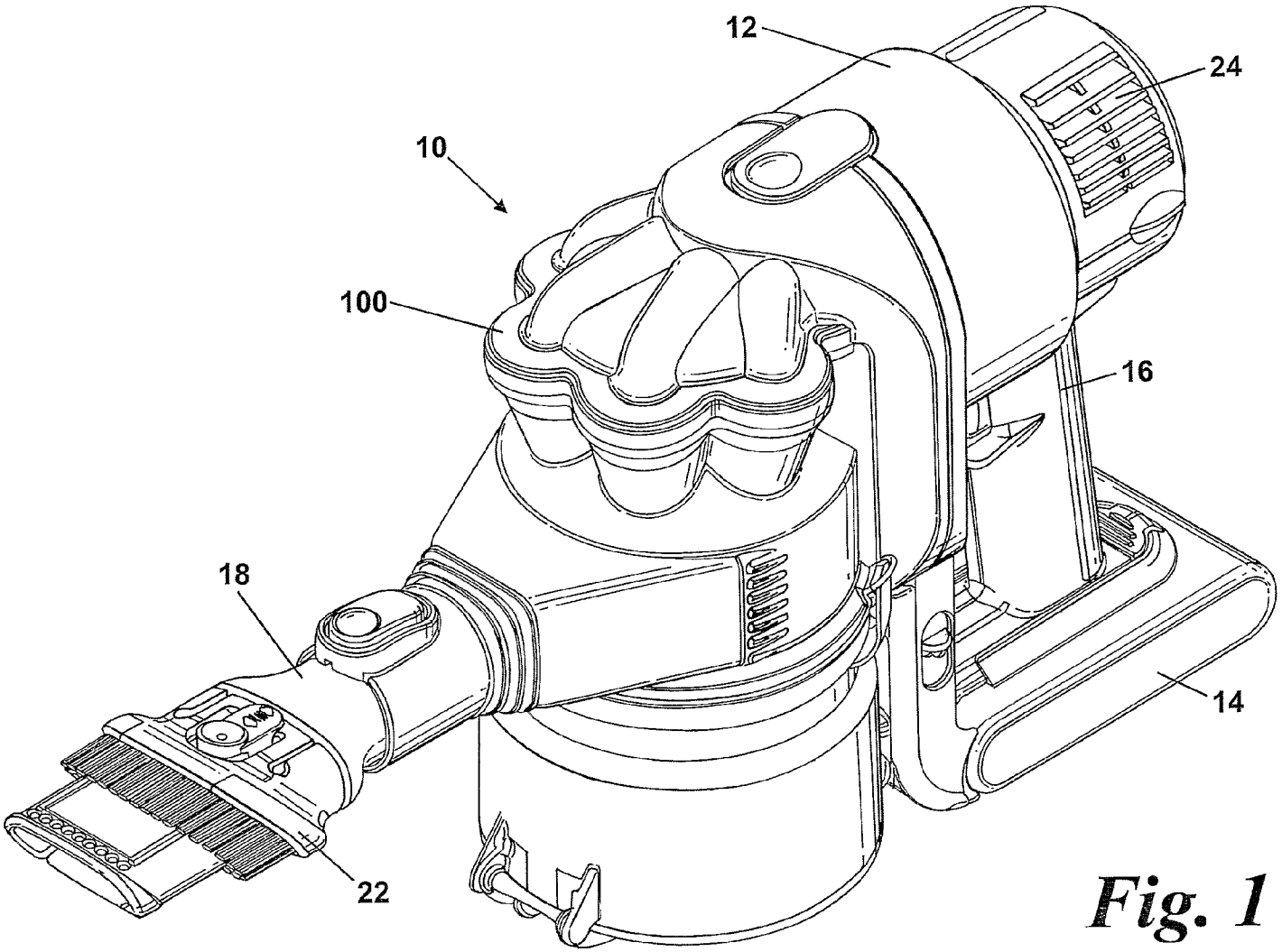
FIG. 1 shows a handheld cleaning appliance according to the invention.
Figure 2:
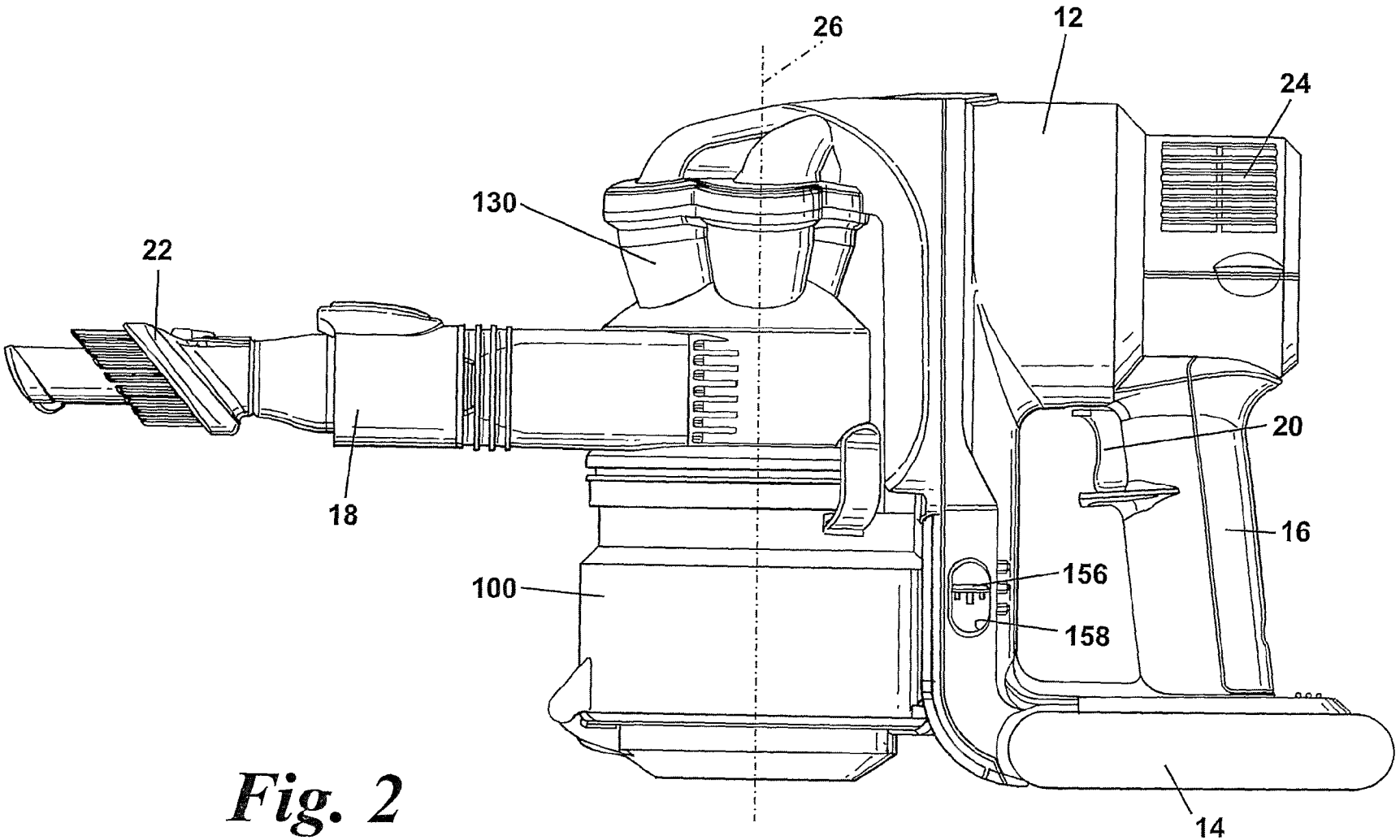
FIG. 2 is a side view of the appliance of FIG. 1.
Figure 3:
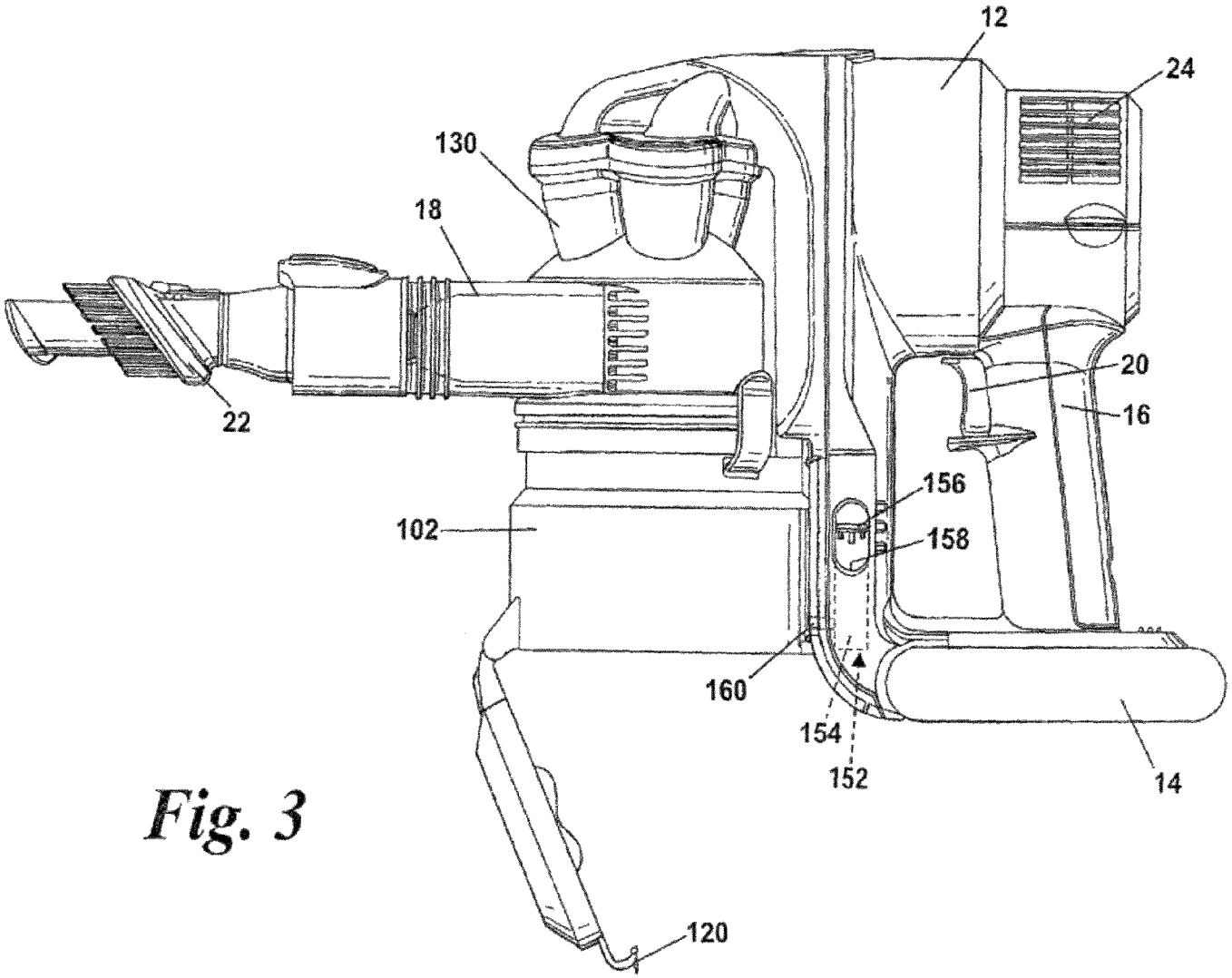
FIG. 3 is a side view of the appliance of FIG. 1 showing the collector base in an open position.

FIGS. 1 to 3 show a handheld vacuum cleaner 10. The handheld vacuum cleaner 10 has a main body 12 which houses a motor and fan unit (not shown). The main body 12 also includes a power source 14 such as a battery. A handle 16 is provided on the main body 12 for manipulating the handheld vacuum cleaner 10 in use. A cyclonic separator 100 is attached to the main body 12. A dirty air inlet 18 extends from a portion of the cyclonic separator 100 remote from the main body 12. A brush tool 22 is slidably mounted on the distal end of the dirty air inlet 18. A set of exhaust vents 24 are provided on the main body 12 for exhausting air from the handheld vacuum cleaner 10.

The cyclonic separator 100 is located between the main body 12 and the dirty air inlet 18. Consequently, the cyclonic separator 100 is located between the handle 16 and the dirty air inlet 18. The cyclonic separator 100 has a longitudinal axis 26 which extends in a generally upright direction so that the axis 26, and therefore the cyclonic separator 100, lies substantially parallel to the direction in which the handle 16 extends.

The orientation of the handle 16 is such that, when the user grips the handle 16, the user's hand forms a fist in a manner similar to that adopted when gripping a saw. This ensures that the user's wrist is not strained more than necessary when manipulating the handheld vacuum cleaner 10 for cleaning purposes. The cyclonic separator 100 is positioned close to the handle 16 which also reduces the moment applied to the user's wrist when the handheld vacuum cleaner 10 is in use. The handle 16 carries an on/off switch 20 in the form of a trigger for turning the vacuum cleaner motor on and off.

Figure 4:
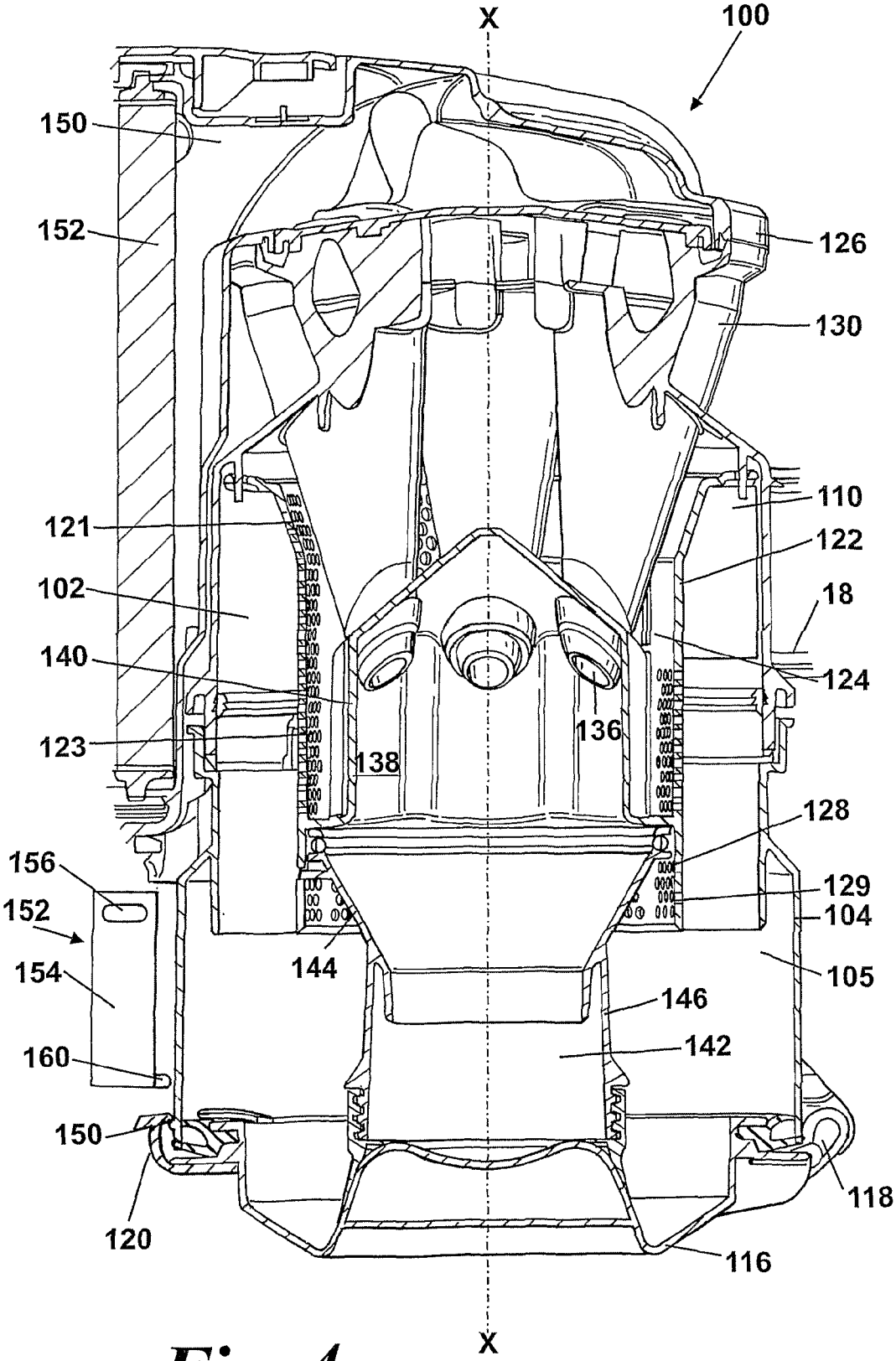
FIG. 4 is a longitudinal cross section through the cyclonic separating apparatus forming part of the appliance of FIG. 1.

The cyclonic separating apparatus 100 forming part of the handheld vacuum cleaner 10 is shown in more detail in FIG. 4. The cyclonic separating apparatus 100 comprises a first cyclone 102 which has a longitudinal axis X-X and a collector 105 having a wall 104. An inlet 110 is formed in the upper portion of the wall 104. The inlet 110 is in communication with the dirty air inlet 18 and forms a communication path between the dirty air inlet 18 and the interior of the first cyclone 102. The air inlet 110 is arranged tangentially to the first cyclone 102 so that the incoming air is forced to follow a helical path around the interior of the first cyclone 102.

A base 116 closes the collector 105 at one end of the first cyclone 102. The base 116 is pivotably mounted on the lower end of the wall 104 by means of a hinge 118. The base 116 is retained in a closed position (as shown FIGS. 1, 2 and 4) by means of a catch 120 which interengages with a lip 150 located on the wall 104. The catch 120 is resiliently deformable so that, in the event that downward pressure is applied to the uppermost portion of the catch 120, the catch will move away from the lip 150 and become disengaged therefrom. In this event, the base 116 will drop away from the wall 104.

An actuator 152 is provided in the main body 12. It is shown schematically in FIGS. 3 and 4. Essentially, the actuator 152 comprises a rod 154 which is slidably mounted inside a part of the main body 12 so as to be movable between a first, inoperative position and a second, operative or actuating position. The first position is shown in FIG. 4. The rod 154 is biased into the first position by a spring or other resilient means which are not shown in the drawings. At or near its upper end, the rod 154 carries a projection 156 which extends laterally away from the rod 154 and projects through an aperture 158 in the main body 12 (see FIGS. 2 and 3). The rod 154 also carries, at its lower end, another projection 160 which extends towards the collector 105 and the catch 120. It also projects through another aperture in the main body 12 so that, when the rod 154 is moved into the second position, the projection 160 comes into contact with the catch 120 and presses it downwardly so that the catch 120 is released from the lip 150.

The rod 154 is moved from the first position to the second position manually by means of the user pressing the projection 156 in a downwards direction against the action of the spring. This causes the catch 120 to be released from the lip 150 and the base 116 then swings away from the wall 104. The catch 120 can also be arranged so that further downward movement of the rod 154 will apply an opening force to the catch 120. This is advantageous in that the seal between the base 116 and the wall 104 will then be broken to allow the base to swing open more freely.

Upon release of the pressure applied by the user to the projection 156, the rod 154 returns to the first position under the action of the spring. The base 116 can be returned to the closed position manually by the user whereupon the catch will re-engage with the lip 150. The presence of the hinge 118 means that the base 116 remains automatically aligned with the wall 104 so that there is little or no risk that the base 116 will be incorrectly positioned when it is returned to the closed position.

A shroud 121 is located inwardly of the wall 104 of the first cyclone 102. The shroud 121 comprises a part-cylindrical, part-frustoconical wall 122 having a plurality of through-holes 123. The shroud 121 surrounds an outlet 124 from the first cyclone 102. The outlet 124 provides a communication path between the first cyclone 102 and a second cyclone assembly 126. A lip 128 is provided at the base of the shroud 121. The lip 128 has a plurality of through-holes 129 which are designed to allow air to pass through but to capture dirt and dust.

The second cyclone assembly 126 comprises a plurality of second cyclones 130 arranged in parallel with one another. In this embodiment, six second cyclones 130 are provided. The second cyclones 130 are arranged around the axis X-X of the first cyclone 102. The arrangement of the second cyclones 130 is such that the second cyclones 130 are spaced equiangularly around the axis X-X. Each second cyclone 130 has a tangentially-arranged air inlet and an air outlet (not shown) located at a first end of the respective second cyclone 130. A cone opening 136 is located at a second end of each second cyclone 130. The plane of the cone opening 136 of each second cyclone 130 is inclined with respect to a longitudinal axis (not shown) of the respective further cyclone 130. The cone opening 136 of each of the second cyclones 130 is in communication with a passageway 138 defined by a wall 140 located inwardly of the shroud 121.

The second end of each second cyclone 130 projects into the interior of the first cyclone 102. However, the first end of each second cyclone 130 lies outside the envelope of the first cyclone 102. In the orientation shown, it is the lower end of each second cyclone 130 which projects into the upper end of the first cyclone 102. The inlet 110 is also arranged at the upper end of the first cyclone 102 so that the inlet 110 is located in the region of the cyclonic separator 100 in which the first and second cyclones 102, 130 overlap. Because the first ends of the second cyclones 130 lie outside the envelope of the first cyclone 102, this region of the cyclone separator 100 lies intermediate the upper end of the cyclone separator 100 and the lower end of the cyclone separator 100. Connecting the dirty air inlet 18 to the cyclone separator 100 at an intermediate portion thereof is beneficial for the manipulation of the handheld vacuum cleaner 10 and avoids the lower extremities of the appliance being accidentally knocked on surfaces away from the area being cleaned.

A collector 142 is located at the lower end of the passageway 138. The collector 142 comprises a frustoconical first portion 144 and a cylindrical second portion 146. The interior of the collector 142 is delimited by the base 116 and the sides of the first and second portions 144, 146 of the collector 142.

Each of the air outlets of the second cyclones 130 is in communication with a duct 150. The duct 150 provides an airflow path from the cyclonic separating apparatus 100 into other parts of the handheld vacuum cleaner 10. Located at the downstream end of the duct 150 is a pre-motor filter 152. The pre-motor filter 152 comprises a porous material such as foam and can also include a fine filter material. The pre-motor filter 152 is designed to prevent any fine dust particles from entering the motor and causing damage thereto.

In use, when the on/off switch 20 is depressed, the motor and fan unit draws a flow of dirt-laden air into the dirty air inlet 18 and then into the cyclonic separator 100. Dirt-laden air enters the cyclonic separator 100 through the inlet 110. Due to the tangential arrangement of the inlet 110, the airflow is forced to follow a helical path around the interior of the wall 104. Larger dirt and dust particles are separated by cyclonic motion around the wall 104. These particles are then collected at the base 116 of the first cyclone 102.

The partially-cleaned airflow then flows back up the interior of the first cyclone 102 and exits the first cyclone 102 via the through-holes 123 in the shroud 121. Once the airflow has passed through the shroud 121, it enters the outlet 124 and from there is divided between the tangential inlets of each of the second cyclones 130. Each of the second cyclones 130 has a diameter which is smaller than that of the first cyclone 102. Therefore, the second cyclones 130 are able to separate smaller particles of dirt and dust from the partially-cleaned airflow than the first cyclone 102. Separated dirt and dust exits the second cyclones 130 via the cone openings 136. Thereafter, the separated dirt and dust passes down the passageway 138 and into the collector 142. The separated dirt and dust eventually settles at the bottom of the collector 142 on the base 116.

Cleaned air then flows back up the second cyclones 130, exits the second cyclones 130 through the air outlets and enters the duct 150. The cleaned air then passes from the duct 150 sequentially through the pre-motor filter 152, the motor and fan unit, and a post-motor filter before being exhausted from the vacuum cleaner 10 through the air vents 24.

The first cyclone 102 and the collector 142 can be emptied simultaneously by releasing the catch 120 to allow the base 116 to pivot about the hinge 118 so that the separated dirt and dust can fall away from the cyclonic separator 100. This is done by the user pressing the projection 156 in a downwards direction against the biasing action of the spring so as to cause the other projection 160 to come into contact with the catch 120. The catch 120 is resiliently deformed away from the lip 150 and is this released therefrom. Further downward movement of the projection 156 ensures that the seal between the base 116 and the wall 104 is broken and the base 116 then swings downwardly away from the wall 104. The dirt and dust collected in the cyclonic separator 100 then falls out of the first cyclone 102 and the collector 142. By positioning the cleaning appliance 10 above a suitable dirt receptacle such as a dustbin, the dirt and dust collected in the cyclonic separator can be efficiently and reliably emptied.

When the cyclonic separator 100 has been emptied as described above, the user may close the cyclonic separator 100 by moving the base 116 back into the closed position shown in FIGS. 1 and 2 by hand. Alternatively, the cleaning appliance may be manipulated so as to swing the base 116 into the closed position. A further alternative would be to place the appliance onto a surface so as to apply a closing force to the base 116 and thereby bring the base 116 into latching contact with the lip 150. The presence of the hinge 118 enables the cyclonic separator 100 to be emptied and subsequently closed without any serious risk of misalignment of the base 116. Misalignment of the base 116 would jeopardise the performance of the appliance.

The invention is not limited to the precise details of the embodiment described above. For example, the number of first and second cyclones can be varied, as can the detail of their design, such as their cone angle, axis inclination and cone opening inclination. The shape of the collector and base can be altered, as can the precise location of the hinge and catch and the location of the actuator. The location of the on/off switch may also be varied.

The invention claimed is:

1. A handheld cleaning appliance comprising a dirty air inlet, a clean air outlet and a separating apparatus for separating dirt and dust from an airflow in an airflow path leading from the air inlet to the air outlet, the separating apparatus comprising a cyclonic separator having at least one cyclone and a collector having a wall and a base member, the base member being held in a closed position by a catch and being pivotably connected to the wall, the appliance further comprising a main body comprising an actuator for operating the catch, wherein the actuator comprises a slidably mounted rod which is movable between an inoperative position and an actuating position in which the rod contacts part of the catch so as to allow the collector to be opened for emptying purposes.

2. The handheld cleaning appliance of claim 1, wherein the base is hinged to a first side of the wall.

3. The handheld cleaning appliance of claim 2, wherein the catch is provided at a location which is diametrically opposed to the hinge.

4. The handheld cleaning appliance of claim 1, 2 or 3, wherein the rod is biased into the inoperative position.

5. The handheld cleaning appliance of claim 1, 2 or 3, wherein the rod comprises a projection which is manually movable with respect to the main body.

6. The handheld cleaning appliance of claim 1, 2 or 3, wherein the rod is located inside a part of the main body.

7. The handheld cleaning appliance of claim 1, 2 or 3, wherein a portion of the collector lies adjacent a portion of the main body.

8. The handheld cleaning appliance of claim 4, wherein the rod comprises a projection which is manually movable with respect to the main body.

9. The handheld cleaning appliance of claim 4, wherein the rod is located inside a part of the main body.

10. The handheld cleaning appliance of claim 4, wherein a portion of the collector lies adjacent a portion of the main body.

11. A handheld cleaning appliance comprising a dirty air inlet, a clean air outlet and separating apparatus for separating dirt and dust from an airflow in an airflow path leading from the air inlet to the air outlet, the separating apparatus comprising a cyclonic separator having at least one cyclone and a collector having a wall and a base member, the base member being held in a closed position by a catch and being pivotably connected to the wall, the appliance further including a main body housing a motor and fan unit for generating an airflow path from the dirty air inlet to the clean air outlet through the cyclonic separator, and a battery for powering the motor and fan unit, the main body further including an actuator for operating the catch, wherein the actuator comprises a rod which is slidably mounted in a part of the main body adjacent the cyclonic separator so as to be movable between an inoperative position and an actuating position in which the rod contacts part of the catch so as to allow the collector to be opened for emptying purposes.

* * * * *